US006165938A

United States Patent [19]

Narita et al.

[11] Patent Number: 6,165,938

[45] Date of Patent: Dec. 26, 2000

[54] THERMAL TRANSFER IMAGE-RECEIVING SHEET

[75] Inventors: Satoshi Narita; Yoshinori Kamikubo, both of Shinjuku-ku, Japan

[73] Assignee: Dai Nippon Printing Co., Ltd., Japan

[21] Appl. No.: 09/119,973

[22] Filed: Jul. 21, 1998

[30] Foreign Application Priority Data

Jul. 22, 1997 [JP] Japan ..... 9-210156

[51] Int. Cl.[7] ..... B41M 5/035; B41M 5/38

[52] U.S. Cl. ..... 503/227; 428/913; 428/914

[58] Field of Search ..... 8/471; 428/195, 428/913, 914; 503/227

[56] References Cited

U.S. PATENT DOCUMENTS

| | | | |
|---|---|---|---|
| 5,318,943 | 6/1994 | Ueno et al. | 503/227 |
| 5,654,039 | 8/1997 | Wenzel et al. | 427/391 |
| 5,897,411 | 4/1999 | Stark | 428/511 |
| 5,929,155 | 7/1999 | Berube | 524/425 |

FOREIGN PATENT DOCUMENTS

| | | | |
|---|---|---|---|
| 0 452 121 A1 | 10/1991 | European Pat. Off. | 503/227 |
| 0 540 991 A1 | 5/1993 | European Pat. Off. | 503/227 |
| 0 545 317 A1 | 6/1993 | European Pat. Off. | 503/227 |
| 0 769 390 A1 | 4/1997 | European Pat. Off. | 503/227 |

OTHER PUBLICATIONS

Patent Abstracts of Japan; vol. 96, No. 6, Jun. 28, 1996 & JP 08 034169 A (Mitsubishi Paper Mills Limited); Feb. 6, 1996 *abstract*.

Patent Abstracts of Japan; vol. 15, No. 447 (M–1179); Nov. 14, 1991 & JP 03 190797 A (Kanzaki Paper Manufacturing K.K.); Aug. 20, 1991; *abstract*.

*Primary Examiner*—Bruce H. Hess
*Attorney, Agent, or Firm*—Parkhurst & Wendel, L.L.P.

[57] ABSTRACT

A thermal transfer image-receiving sheet is provided which causes none of a dimensional change, curling, misregistration of image and can produce a printed image having satisfactory image quality and density. The thermal transfer image-receiving sheet comprises: a paper substrate; and a dye-receptive layer provided on one side of the substrate, a water vapor barrier layer composed mainly of a resin being provided on at least the side of the thermal transfer image-receiving sheet remote from the dye-receptive layer.

4 Claims, No Drawings

THERMAL TRANSFER IMAGE-RECEIVING SHEET

BACKGROUND OF THE INVENTION

This invention relates to a thermal transfer image-receiving sheet which, in use, is superposed onto a thermal dye donor sheet, and more particularly to a thermal transfer image-receiving sheet having texture similar to plain paper.

Various thermal transfer recording systems are known in the art. Among these known systems is a thermal dye transfer system, wherein a sublimable dye as a colorant is transferred, using a thermal head capable of generating heat in response to a recording information, onto an image-receiving sheet to produce an image.

According to this recording system, since a sublimable dye is used as a colorant, density gradation can be controlled as desired and can reproduce a full-color image of an original image. Further, the formed dye image is very sharp and highly transparent and hence is excellent in reproduction of halftone and gradation, realizing a high-quality image comparable to a silver-salt photographic image.

A plastic sheet, a laminated sheet composed of a plastic sheet and paper or the like, or a synthetic paper or the like has been used as a thermal transfer image-receiving sheet in the thermal dye transfer system. In order to spread utilization of the thermal dye transfer system to general offices, use of plain papers, such as coated paper (art paper), cast coated paper, and paper for PPC, as a substrate sheet for the image-receiving sheet has been proposed in the art.

The conventional thermal transfer image-receiving sheet comprising a dye-receptive layer provided on one side of a paper substrate often poses the following problems. Specifically, paper per se contains water in an amount of about several % by weight. The amount of water contained in terms of % by weight refers to water content. The water content is not always constant and varies depending upon environmental humidity. Under high humidity environment, the paper substrate absorbs moisture in the air, leading to an increase in dimension of pulp which is a main constituent of the paper. On the other hand, under low humidity environment, the paper substrate releases water contained therein into the environment, leading to a reduction in dimension of the pulp. The dimensional change is significant in the cross direction of fibers of the pulp rather than in the direction of fibers in the pulp. The dimensional change of the pulp results in the dimensional change of the paper per se.

In a paper substrate which has been continuously produced by a conventional continuous papermaking machine, the pulp is likely to align in the machine direction (MD) of paper. Therefore, the dimensional change created by the absorption and release of moisture is more significant in the cross direction (CD) relative to the machine direction. Thus, the thermal transfer image-receiving sheet using a paper substrate creates a dimensional change due to absorption and release of moisture, often causing troubles associated with loading of the thermal transfer image-receiving sheet into a printer or carrying of the thermal transfer image-receiving sheet within the printer.

Further, a thermal transfer image-receiving sheet comprising a paper substrate and at least a dye-receptive layer provided on one side of the paper substrate often causes curling due to a difference in stretching behavior between the substrate portion and the portion of several layers including the dye-receptive layer. The curling leads to troubles associated with loading of the thermal transfer image-receiving sheet into a printer or carrying of the thermal transfer image-receiving sheet within the printer and in addition remarkably deteriorates the appearance of the print.

Further, in the thermal transfer method, at the time of printing, a thermal transfer sheet is heated by means of a thermal head or the like to transfer a colorant onto a thermal transfer image-receiving sheet in intimate contact with the thermal transfer sheet. Therefore, the temperature of the thermal transfer image-receiving sheet also is increased. This causes water contained in the substrate to be evaporated to create a dimensional change.

In particular, in printing a color image, an original image is subjected to color separation into three colors of yellow, magenta, and cyan, or four colors of yellow, magenta, cyan, and black, and colorants of respective colors are successively transferred to form a color image. Therefore, in transferring each color, the image-receiving sheet gradually undergoes a dimensional change, often leading to misregistration of image.

Further, when the water content of the image-receiving sheet before printing, that is, the image-receiving sheet at the time of preparation thereof, is lower than a given value, moisture absorption occurs at the time of paper feed. Also in this case, the image-receiving sheet undergoes a dimensional change, often leading to misregistration of image.

In the case of an image-receiving sheet in a sheet form, when several sheets are put on top of another on a feeding tray, the interior sheet located between surface sheets does not easily undergo a change in water content. Since, however, at the time of feeding, both sides of the image-receiving sheet are exposed to printing environment, a change in water content, that is, a dimensional change, often occurs. On the other hand, in the case of an image-receiving sheet in a roll form, the center portion of the roll does not easily undergo a change in water content. In this case as well, in feeding, both sides of the image-receiving sheet are exposed to printing environment, often leading to a change in water content, that is, a dimensional change.

Accordingly, an object of the present invention is to solve the above problems of the prior art and to provide a thermal transfer image-receiving sheet that causes none of a dimensional change, curling, and misregistration of image and can produce a printed image having satisfactory image quality and density.

DISCLOSURE OF INVENTION

The above object of the present invention can be attained by a thermal transfer image-receiving sheet comprising: a paper substrate; and at least a dye-receptive layer provided on one side of the paper substrate, a water vapor barrier layer composed mainly of a resin being provided on at least the side of the thermal transfer image-receiving sheet opposite to the side having the dye-receptive layer.

According to the present invention, provision of a water vapor barrier layer, composed mainly of a resin having low water vapor permeability, on a thermal transfer image-receiving sheet, comprising a dye-receptive layer provided on one side of a paper substrate, at least in its side opposite to the dye-receptive layer and, further, preferably, regulation of the water content of the thermal transfer image-receiving sheet at the time of preparation thereof can inhibit a change in water content of the substrate, causes none of a dimensional change, curling, and misregistration of image in the thermal transfer image-receiving sheet, and can produce a printed image having satisfactory image quality and density.

BEST MODE FOR CARRYING OUT THE INVENTION

The present invention will be described in more detail with reference to the following preferred embodiments.

The thermal transfer image-receiving sheet according to the present invention basically comprises a paper substrate, a dye-receptive layer, and a water vapor barrier layer provided on the substrate in its side remote from the dye-receptive layer. The substrate and the layers constituting the thermal transfer image-receiving sheet will be described.

Substrate

Commonly used natural pulp papers can be used as the substrate in the present invention. Papers used as the substrate are not particularly limited, and examples thereof include wood-free papers, art papers, lightweight coated papers, slightly coated papers, coated papers, cast coated papers, synthetic resin- or emulsion-impregnated papers, synthetic rubber latex-impregnated papers, papers with synthetic resin internally added thereto, and papers for thermal transfer. Among them, wood-free papers, lightweight coated papers, slightly coated papers, coated papers, and papers for thermal transfer are preferred. The thickness of the substrate is 40 to 300 μm, preferably 60 to 200 μm.

Dye-receptive layer

The dye-receptive layer provided on the paper substrate serves to receive a sublimable dye transferred from a thermal transfer sheet and to hold the formed image. Resins usable for the dye-receptive layer include, for example, polyolefin resins, such as polypropylene, polyvinyl chloride, vinyl chloride/vinyl acetate copolymer, ethylene/vinyl acetate copolymer, halogenated polymers, such as polyvinylidene chloride, vinyl polymers, such as polyvinyl acetate and polyacrylic esters, polyester resins, such as polyethylene terephthalate and polybutylene terephthalate, polystyrene resin, polyamide resin, resin of copolymer of olefin, such as ethylene or propylene, with other vinyl monomer, ionomers, cellulosic resins, such as cellulose diacetate, and polycarbonate. Vinyl resin and polyester resin are particularly preferred.

In forming a dye-receptive layer from the above resin, incorporation of a release agent into the resin is preferred from the viewpoint of preventing fusing between the thermal transfer sheet and the dye-receptive layer at the time of thermal transfer. Preferred release agents usable herein include silicone oils, phosphoric ester surfactants, and fluorosurfactants. Among them, silicone oils are preferred.

Preferred silicone oils include modified silicone oils, such as epoxy-modified, alkyl-modified, amino-modified, carboxyl-modified, alcohol-modified, fluorine-modified, alkyl aralkyl polyether-modified, epoxy-polyether-modified, and polyether-modified silicone oils. These release agents are used alone or as a mixture of two or more.

The amount of the release agent added is preferably in the range of from 0.5 to 30 parts by weight based on 100 parts by weight of the resin for the dye-receptive layer. When the amount is outside the above range, there is a fear of problems, such as fusing of the dye-receptive layer to the thermal transfer sheet or lowered sensitivity in printing, being posed. Addition of the release agent to the dye-receptive layer permits the release agent to bleed out on the surface of the dye-receptive layer, after transfer, to form a release layer.

The dye-receptive layer may be formed on the surface of the paper substrate by coating a solution or dispersion of the above resin, with necessary additives, such as a release agent, incorporated therein, dissolved or dispersed in a suitable organic solvent, for example, by gravure printing, screen printing, reverse roll coating or other forming means using a gravure plate and drying the coating.

In the formation of the dye-receptive layer, optical brighteners, titanium oxide, zinc oxide, kaolin clay, calcium carbonate, finely divided silica, or other pigments or fillers may be added from the viewpoint of improving the whiteness of the dye-receptive layer to further enhance the sharpness of the transferred image. Although the dye-receptive layer may have any desired thickness, it is generally 1 to 50 μm.

Water vapor barrier layer

A water vapor barrier layer which is a main characteristic feature of the present invention is provided on the substrate in its side opposite to the dye-receptive layer. The water vapor barrier layer should be formed of a material having low permeability to moisture (water vapor). Specifically, a film composed mainly of a resin, a deposited metal film or the like satisfied the above requirement. Preferred is the film composed mainly of a resin from the viewpoint of cost and texture.

Resins usable herein include various thermoplastic resins, for example, polyolefin resins, such as polyethylene and polypropylene, acrylic resin, styrene/acrylic resin, polyester resin, polyurethane resin, polyacetal resin, polyamide resin, polycarbonate resin, polyvinyl chloride resin, and polyvinylidene chloride resin. Among them, polyvinylidene chloride resin having the lowest water vapor permeability is particularly preferred.

A crosslinking product of the above resin and a mixture or copolymer of a plurality of the above resins can also be effectively utilized. In addition, melamine resin, epoxy resin and other thermosetting resins may also be used. In this case, however, there is a fear of heating, for curing, having an adverse effect on the properties of the thermal transfer image-receiving sheet, and, hence, care should be taken when the thermosetting resin is used. Further, inorganic pigments, for example, calcium carbonate, talc, kaolin, titanium oxide, zinc oxide and other conventional inorganic pigments, and optical brighteners may be incorporated into the water vapor barrier layer from the viewpoint of imparting the opaqueness or whiteness or of regulating the texture of the thermal transfer image-receiving sheet. The proportion of the pigment or the like incorporated is preferably 10 to 200 parts by weight based on 100 parts by weight on a dry basis of the resin. When the proportion is less than 10 parts by weight, the above effect is unsatisfactory. On the other hand, when the proportion exceeds 200 parts by weight, the dispersion stability of the pigment or the like is unsatisfactory. Further, in this case, in some cases, water vapor barrier properties inherent in the resin cannot be provided.

Methods usable for forming the water vapor barrier layer include various coating methods, such as roll coating, gravure coating, and extrusion coating, and lamination methods wherein the above material for a water vapor barrier layer is previously formed as a film or a sheet which is then laminated onto a paper substrate. In some cases, however, a suitable method is limited according the resin and pigment used. In the case of the polyvinylidene chloride, coating as an organic solvent solution or aqueous emulsion of the resin is suitable.

The thickness of the water vapor barrier layer is preferably in the range of from 1 to 15 $g/m^2$, more preferably in the range of from 2 to 10 $g/m^2$. When the thickness is less than 1 $g/m^2$, the water vapor permeability is not satisfactorily low. On the other hand, a thickness exceeding 15 $g/m^2$ results in saturation of the effect attained by the water vapor barrier layer and loss of the texture of the paper substrate and is cost-ineffective.

Water content of thermal transfer image-receiving sheet

In order to inhibit the dimensional change of the thermal transfer image-receiving sheet, it is necessary to provide a water vapor barrier layer and to regulate the water content of the thermal transfer image-receiving sheet at the time of preparation thereof. When the water content of the thermal transfer image-receiving sheet at the time of preparation thereof is a given value or less, the thermal transfer image-receiving sheet absorbs moisture at the time of feeding, leading to a dimensional change of the thermal transfer image-receiving sheet, which often creates misregistration of image.

The water content of the thermal transfer image-receiving sheet is preferably 3.0 to 10%, more preferably 3.5 to 10%. When the water content exceeds 10%, the thermal transfer image-receiving sheet is unfavorably deformed.

In the thermal transfer image-receiving sheet of the present invention, at least a dye-receptive layer is provided on at least one side of the paper substrate. Due to the presence of the dye-receptive layer or other layer(s) adjacent to the paper substrate, the water vapor permeability of the thermal transfer image-receiving sheet is lower than the paper substrate per se. Therefore, in some cases, provision of the water vapor barrier layer on the substrate only in its side remote from the dye-receptive layer suffices for satisfactory results. However, when a plurality of layers on the dye-receptive layer side are a discontinuous layer or comprise a material having high water vapor permeability, the water vapor barrier layer may be additionally provided also on the dye-receptive layer side. In this case, the position at which the water vapor barrier layer is provided may be determined by paper substrate, function of each layer, adhesion between layers and the like. The above resin having low water vapor permeability may be used in a layer, such as an undercoat or an intermediate layer so that this layer serves also as the water vapor barrier layer.

Other layers

In addition to the above substrate, dye-receptive layer, and water vapor barrier layer, the following optional layers may be preferably incorporated in the thermal transfer image-receiving sheet of the present invention.

(Undercoat)

When a heat-insulating, foam layer is provided between the dye-receptive layer and the substrate, preferably, an undercoat is provided on the substrate. The undercoat, when a coating liquid for a foam layer is coated on the substrate, prevents penetration of the coating liquid into the substrate, permitting the foam layer to be formed in a desired thickness. In the formation of the foam layer through foaming by heating, the expansion ratio can be enhanced, the cushioning properties of the whole image-receiving sheet can be improved, and the amount of the coating liquid for the foam layer can be reduced for forming the foam layer having desired thickness, which is cost-effective.

(Foam layer)

A foam layer may be provided on the undercoat, and the dye-receptive layer may be provided on the foam layer. The foam layer may be formed from a foamable layer composed mainly of a resin and a foaming agent. The foam layer has high cushioning properties and, hence, even when paper is used as the substrate, an image-receiving sheet having high sensitivity in printing can be provided. A particularly preferred foaming agent is a low-temperature foaming type microsphere, which has a partition softening temperature of 100° C. or below, a foaming initiation temperature of 100° C. or below, and an optimal foaming temperature (a temperature at which the highest expansion ratio can be provided in a heating time of one min) of 140° C. or below, from the viewpoint of rendering the mildest possible heating conditions usable in the foaming.

Use of the microsphere having a low foaming temperature can prevent the substrate from being cockled upon heating at the time of foaming. The microsphere having a low foaming temperature can be prepared by regulating the amount of a thermoplastic resin, such as polyvinylidene chloride or polyacrylonitrile, incorporated for forming the partition. The volume average particle diameter of the microsphere is 5 to 15 $\mu$m. The foam layer using the microsphere has advantages including that cells formed by foaming are closed cells, what is required for foaming is simply to conduct heating, and the thickness of the foam layer can be easily regulated by regulating the amount of the microsphere incorporated. The thickness of the whole foam layer is preferably 30 to 100 $\mu$m.

(Intermediate layer)

When the foaming agent in the foamable layer is foamed, uneven irregularities on the order of several tens of $\mu$m are created on the surface of the resultant foam layer. This in turn causes the dye-receptive layer provided thereon to unfavorably have surface irregularities. When an image is formed on the image-receiving sheet, the resultant image suffers from dropouts and voids and does not have high sharpness and resolution. Provision of an intermediate layer formed of a flexible or elastic material on the foam layer can eliminate the problem associated with surface irregularities of the foam layer. The provision of the intermediate layer can realize an image-receiving sheet wherein, even when the dye-receptive layer has surface irregularities, the surface irregularities do not influence the quality of the printed image. The intermediate layer is formed of a highly flexible, elastic resin, specifically urethane resin, vinyl acetate resin, acrylic resin, or a copolymer thereof, or a blend of these resins.

Inorganic pigments, such as calcium carbonate, talc, kaolin, titanium oxide, zinc oxide, and other conventional inorganic pigments, and optical brighteners may be incorporated into the intermediate layer or the foam layer in order to impart opaqueness or whiteness or to regulate the texture of the thermal transfer image-receiving sheet. The proportion of the pigment or the like is preferably 10 to 200 parts by weight based on 100 parts by weight of the resin on a solid basis. When the proportion is less than 10 parts by weight, the contemplated effect is small. On the other hand, a proportion exceeding 200 parts by weight results in poor dispersion stability of the pigment or the like or otherwise makes it impossible to provide properties inherent in the resin. The coverage of the intermediate layer is preferably in the range of from 1 to 20 g/m$^2$. When the coverage is less than 1 g/m$^2$, the cell protective function is unsatisfactory. On the other hand, when the coverage exceeds 20 g/m$^2$, heat-insulating/cushioning properties and the like cannot be unfavorably attained by the foam layer.

(Backside layer)

A slippery backside layer may be provided on the image-receiving sheet in its side remote from the dye-receptive layer, that is, on the water vapor barrier layer side, according to the carrying system of the image-receiving sheet of the printer used. An inorganic or organic filler may be dispersed in the resin constituting the backside layer in order to impart slip properties to the backside layer. A conventional resin or a mixture of two or more conventional resins may be used as the resin for the slippery backside layer. Alternatively, a slip or release agent, such as silicone, may be added to the backside layer. The coverage of the backside layer is preferably 0.05 to 3 g/m$^2$.

Thermal transfer sheets used, for thermal transfer, in combination with the above image-receiving sheet include a thermal dye transfer sheet for use in a thermal dye transfer system and a thermal ink transfer sheet, comprising a substrate and, coated thereon, a hot-melt ink layer of a pigment or the like, held by a hot-melt binder, which upon heating the ink layer, in its entirety, is transferred to an object.

In the thermal transfer, thermal energy may be applied by any conventional means. For example, a desired image can be formed by applying a thermal energy of about 5 to 100 mJ/mm$^2$ through the control of a recording time by means of a recording device, such as a thermal printer (for example, Rainbow 2720, manufactured by Sumitomo 3M Ltd.)

The present invention will be described in more detail with reference to the following examples and comparative examples. In the following description, all "parts" or "%" are by weight.

EXAMPLE 1

A coated paper having a basis weight of 104.7 g/m$^2$ (New V Matt, manufactured by Mitsubishi Paper Mills Limited) was first provided as a substrate. An undercoat having the following composition was gravure-coated on the substrate at a coverage of 5 g/m$^2$, and the coating was dried by a hot air drier to form an undercoat layer.

(Composition of coating liquid for undercoat)

| | |
|---|---|
| Acrylic resin (manufactured by Soken Chemical Engineering Co., Ltd., EM) | 100 parts |
| Precipitated barium sulfate (manufactured by Sakai Chemical Co., Ltd., #300) | 30 parts |
| Toluene | 400 parts |

A foamable layer having the following composition was gravure-coated on the undercoat at a coverage of 20 g/m$^2$, and the coating was hot-dried by means of a hot air drier at 140° C. for one min to foam the microsphere, thereby forming a foam layer.

(Composition of coating liquid for foamable layer)

| | |
|---|---|
| Styrene/acrylic copolymer emulsion (manufactured by Nippon Carbide Industries Co., Ltd., RX 941A, solid content 54%) | 100 parts |
| Microsphere (manufactured by Matsumoto Yushi Seiyaku Co., Ltd., F30 VS, foaming initiation temp. 80° C.) | 10 parts |
| Water | 20 parts |

A coating liquid, for an intermediate layer, having the following composition was gravure-coated on the foam layer at a coverage of 5 g/m$^2$, and the coating was dried by means of a hot air drier to form an intermediate layer.

(Composition of coating liquid for intermediate layer)

| | |
|---|---|
| Acrylic resin emulsion (manufactured by Nippon Carbide Industries Co., Ltd., FX 337C, solid content 59%) | 100 parts |
| Water | 20 parts |

A coating liquid, for a dye-receptive layer, having the following composition was gravure-coated on the foam layer at a coverage of 3 g/m$^2$, and the coating was dried by means of a hot air drier to form a dye-receptive layer.

(Composition of coating liquid for dye-receptive layer)

| | |
|---|---|
| Vinyl chloride/vinyl acetate copolymer (manufactured by Denki Kagaku Kogyo K.K., #1000D) | 100 parts |
| Amino-modified silicone (manufactured by The Shin-Etsu Chemical Co., Ltd., X-22-349) | 3 parts |
| Epoxy-modified silicone (manufactured by The Shin-Etsu Chemical Co., Ltd., KF-393) | 3 parts |
| Methyl ethyl ketone/toluene = 1/1 | 400 parts |

The assembly was then allowed to stand in an environment of 25° C./50% RH for 96 hr to conduct conditioning. Thereafter, a coating liquid, for a water vapor barrier layer, having the following composition was gravure-coated at a coverage of 5 g/m$^2$ on the substrate in its side remote from the dye-receptive layer, and the coating was dried in an oven at 110° C. for 30 sec to form a water vapor barrier layer. Thus, a thermal transfer image-receiving sheet of the present invention was prepared. The thermal transfer image-receiving sheet was cut into a size of 10 cm×10 cm, and the water content was measured with the following measuring device (a moisture meter) under the following measuring conditions and found to be 3.5%.

(Composition of coating liquid for water vapor barrier layer)

| | |
|---|---|
| Vinylidene chloride copolymer latex (manufactured by Asahi Chemical Industry Co, Ltd., Saran latex L407, solid content 49%) | 100 parts |
| Water | 30 parts |
| Antifoaming agent (manufactured by Sannopco, SN defoamer 1407K) | 0.1 part |

(Measuring device for water content and measuring conditions)

Moisture meter: moisture meter manufactured by Kett Electric Laboratory Co., Ltd., FD-230)

Measuring conditions: 130° C. for 10 min

EXAMPLE 2

A thermal transfer image-receiving sheet was prepared in the same manner as in Example 1, except that the coverage of the water vapor barrier layer was 3 g/m$^2$.

EXAMPLE 3

A thermal transfer image-receiving sheet was prepared in the same manner as in Example 1, except that the coverage of the water vapor barrier layer was 9 g/m$^2$.

EXAMPLE 4

A thermal transfer image-receiving sheet was prepared in the same manner as in Example 1, except that the following coating liquid was used instead of the coating liquid for a water vapor barrier layer.

| | |
|---|---|
| Vinylidene chloride copolymer latex (manufactured by Asahi Chemical Industry Co, Ltd., Saran latex L521, solid content 50%) | 100 parts |
| Titanium oxide (Ishihara Sangyo kaisha Ltd., TT-055 (A)) | 50 parts |
| Water | 30 parts |
| Antifoaming agent (manufactured by Sannopco, SN defoamer 1407K) | 0.1 part |

EXAMPLE 5

A thermal transfer image-receiving sheet was prepared in the same manner as in Example 1, except that the water vapor barrier layer was provided on the thermal transfer image-receiving sheet in its side opposite to the dye-receptive layer and, in addition, between the undercoat and the foam layer on the dye-receptive layer side.

COMPARATIVE EXAMPLE 1

A thermal transfer image-receiving sheet of Comparative Example 1 was prepared in the same manner as in Example 1, except that the provision of a water vapor barrier layer was omitted.

EXAMPLE 6

A thermal transfer image-receiving sheet of the present invention was prepared in the same manner as in Example 1, except that the coverage of the water vapor barrier layer was 0.5 g/m$^2$.

EXAMPLE 7

A thermal transfer image-receiving sheet of the present invention was prepared in the same manner as in Example 1, except that the coverage of the water vapor barrier layer was 20 g/m$^2$.

EXAMPLE 8

A thermal transfer image-receiving sheet of the present invention was prepared in the same manner as in Example 1, except that after the water vapor barrier layer was coated, the assembly was placed in an oven at 130° C. for 5 min. The water content was measured in the same manner as in Example 1 and found to be 1.3%.

EXAMPLE 9

A thermal transfer image-receiving sheet of the present invention was prepared in the same manner as in Example 1, except that, in the composition of a coating liquid for a water vapor barrier layer, the amount of water was changed to 100 parts by weight. The water content was measured in the same manner as in Example 1 and found to be 5.3%.

Thermal transfer image-receiving sheets of the examples and the comparative examples were evaluated as follows. The results were as summarized in Table 1 below.

<Dimensional change>

The thermal transfer image-receiving sheet was allowed to stand in an environment of 25° C./50% RH for 24 hr and then cut into a size of 10 cm×10 cm, and the sample was then allowed to stand in an environment of 40° C./90% RH for 5 hr. The dimensional change in the machine direction and the cross direction was measured. The sum (mm) of the absolute value of the dimensional change in the machine direction and the absolute value of the dimensional change in the cross direction was determined and evaluated according to the following criteria.

○: less than 0.5 mm

Δ: 0.5 to less than 1.0 mm

×: not less than 1.0 mm

<Water vapor permeability>

The water vapor permeability was measured according to the procedure as set forth in JIS Z 0208 (cup method) and evaluated according to the following criteria.

○: less than 200 g/m$^2$·24 hr

Δ: 200 to less than 300 g/m$^2$·24 hr

×: not less than 300 g/m$^2$·24 hr

<Curling>

The thermal transfer image-receiving sheet was allowed to stand in an environment of 25° C./50% RH for 24 hr and then cut into a size of 10 cm×10 cm. The sample was then put so that the surface of the dye-receptive layer faced upward. The height (mm) of four corners from the floor surface was measured. The sample was then allowed to stand in an environment of 40° C./90% RH for 5 hr, and the height (mm) of four corners from the floor surface was measured again. The sum (mm) of the absolute value of a change in height was determined and evaluated according to the following criteria.

○: less than 20 mm

Δ: 20 to less than 30 mm

×: not less than 30 mm

<Registration in printing>

A print was evaluated using a dye sublimation type thermal printer (Rainbow 2720) manufactured by Imation and a specialty thermal transfer sheet for the above printer. A printed image was such that, in paper of size A4, a register mark for a registration test was disposed at four corners of YMCK black solid image of 25 cm in length and 17 cm in width. The deviation width (mm) of four register marks in the machine direction and in the cross direction was measured. The sum (mm) of the absolute value of the deviation width (mm) of four register marks in the machine direction and in the cross direction was determined and evaluated according to the following criteria.

○: less than 0.5 mm

Δ: 0.5 to less than 1.0 mm

×: not less than 1.0 mm

TABLE 1

| | (Evaluation results) | | | |
|---|---|---|---|---|
| Sample | Dimensional change | Water vapor permeability | Curl-ing | Registration in printing |
| Ex. 1 | ○ | ○ | ○ | ○ |
| Ex. 2 | ○ | ○ | ○ | ○ |
| Ex. 3 | ○ | ○ | ○ | ○ |
| Ex. 4 | ○ | ○ | ○ | ○ |
| Ex. 5 | ○ | ○ | ○ | ○ |
| Ex. 6 | Δ | Δ | Δ | Δ |
| Ex. 7 | ○ | ○ | Δ | ○ |
| Ex. 8 | Δ | ○ | Δ | Δ |
| Ex. 9 | ○ | ○ | ○ | ○ |
| Comp. Ex. 1 | x | x | x | x |

As described above, according to the present invention, provision of a water vapor barrier layer, composed mainly of a resin having low water vapor permeability, on a thermal transfer image-receiving sheet, comprising a dye-receptive layer provided on one side of a paper substrate, at least in its side opposite to the dye-receptive layer can inhibit a change in water content of the substrate, causes none of a dimensional change, curling, and misregistration of image in the thermal transfer image-receiving sheet, and can produce a printed image having satisfactory image quality and density.

What is claimed is:

1. A thermal transfer image-receiving sheet comprising:

a paper substrate;

a dye-receptive layer provided on one side of the paper substrate; and a water vapor barrier layer composed mainly of polyvinylidene chloride resin being provided on at least the side of the thermal transfer image-receiving sheet opposite to the side having the dye-receptive layer.

2. The thermal transfer image-receiving sheet according to claim 1, wherein the water vapor barrier layer has a water vapor permeability of less than 200 $g/m^2 \cdot 24$ hr.

3. The thermal transfer image-receiving sheet according to claim 2, which has a water content of 3.0 to 10%.

4. The thermal transfer image-receiving sheet according to claim 1, which has a water content of 3.0 to 10%.

* * * * *